US006699817B2

(12) United States Patent
Mizuhara et al.

(10) Patent No.: US 6,699,817 B2
(45) Date of Patent: Mar. 2, 2004

(54) THERMAL TRANSFER RECORDING SHEET

(75) Inventors: Yoshio Mizuhara, Tokyo (JP); Yoshihiro Shimizu, Yokohama (JP); Shigeru Nagashima, Tokyo (JP); Yoshimasa Tanaka, Tokyo (JP); Kazuyuki Tachibana, Tokyo (JP)

(73) Assignee: Oji Paper Co., Ltd., Tokyo (JP)

( * ) Notice: Subject to any disclaimer, the term of this patent is extended or adjusted under 35 U.S.C. 154(b) by 162 days.

(21) Appl. No.: 10/087,827

(22) Filed: Mar. 5, 2002

(65) Prior Publication Data

US 2003/0003276 A1 Jan. 2, 2003

(30) Foreign Application Priority Data

Mar. 5, 2001 (JP) ..... 2001-060085

(51) Int. Cl.[7] ..... B41M 5/035; B41M 5/38
(52) U.S. Cl. ..... 503/227; 428/32.39
(58) Field of Search ..... 428/32.39; 503/227

(56) References Cited

U.S. PATENT DOCUMENTS 4,734,396 A * 3/1988 Harrison et al. ..... 503/227
5,314,861 A 5/1994 Morohoshi et al. ..... 503/227
5,330,961 A 7/1994 Takeyama et al. ..... 503/227

FOREIGN PATENT DOCUMENTS

| | | | |
|---|---|---|---|
| JP | 62198497 A | * | 9/1987 |
| JP | 02225086 | | 9/1990 |
| JP | 02225086 A | * | 9/1990 |
| JP | 06040169 A | * | 2/1994 |
| JP | 08011444 A | * | 1/1996 |
| JP | 2000071625 A | * | 3/2000 |

OTHER PUBLICATIONS

JIS K 7220, 1995.*
European Search Report EP 02 07 5872, May 17, 2002.

* cited by examiner

*Primary Examiner*—Bruce H. Hess
(74) *Attorney, Agent, or Firm*—Arent Fox Kintner Plotkin & Kahn

(57) ABSTRACT

A thermal transfer recording sheet having a high resistance to denting due to the nipping pressure and/or thermal printing pressure has a substrate sheet including a core sheet and polyester films laminated on the two surfaces of the core sheet and an image receiving layer formed on a surface of the substrate sheet and containing a dyeable polymeric material, and exhibits a compression modulus of 50 MPa or less.

7 Claims, No Drawings

THERMAL TRANSFER RECORDING SHEET

BACKGROUND OF THE INVENTION

1. Field of the Invention

The present invention relates to a thermal transfer recording sheet. More particularly, the present invention relates to a thermal transfer recording sheet appropriate for thermal transfer printers and, especially, dye-thermal transfer printers, provided with a glossy surface, having a high resistance to roughening and denting due to nipping pressure of a recording sheet-transporting roller system of the printers, and capable of recording thereon thermally transferred images having high clarity and accuracy comparable to those of silver salt photograph.

2. Description of the Related Art

The dye-thermal transfer printer forms dye images on an image receiving layer of a thermal transfer recording sheet by superposing a dye ink sheet on the image receiving layer, comprising a dyeable polymeric material, of the recording sheet and applying heat imagewise to the superposed dye ink sheet on the ink receiving layer of the recording sheet through a thermal head to cause the dye in the dye ink sheet to be transferred imagewise, in an amount corresponding to the amount of the applied heat, onto the ink receiving layer.

For the dye thermal transfer printer, yellow-, magenta- and cyan-coloring ink sheets or the above-mentioned three color-coloring ink sheets and black-coloring ink sheets are employed. Full-colored images can be formed by superposing colored images transferred from the above-mentioned three or four color-coloring ink sheets on each other on the image receiving layer.

Currently, the development of the thermal transfer printers and the progress of digital image-treatment enable the quality of the recorded images to be significantly enhanced and the thermal transfer recording systems to be sold in an expanded field. Typically, the thermal transfer recording systems are utilized for outputting and proofing of prints and designs, image-outputting of endoscopes and CT-scanners, outputting of photographs of faces in the amusement field, calendar-printing and putting images on ID cards and credit cards. Also, due to the enhancement of the performance of the thermal heads and the progress of the temperature-control technology, an further enhancement of the printing speed of the thermal transfer recording system is required. Currently, a new type of printer capable of printing a A6 size sheet within a time of 30 seconds or less has appeared on the market. It is expected that a further development in the high speed printer will be strongly demanded.

The increase in the printing speed causes problems on gradation of the color density of images and accuracy of images and prevention of shear in printed colored images. To obtain good gradation of the color density of the printed images, it is necessary to produce the color density of the images in a broad range by applying energy. To produce, in a narrow range, a high color density of images even using low energy, the recording sheet must have a high heat insulation property. Also, to obtain high accuracy in the images, the recording sheet must be brought into close contact with the thermal head of the printer, and for this purpose, the recording sheet must have a good cushioning property.

Further, to prevent shearing in the printed colored images, the recording sheet is transported through a nipping roller system comprising a roller equipped with a spike and a rubber roller. When the printing is carried out at a high speed, the nipping pressure applied to the recording sheet between the spike roller and the rubber roller must be increased. In this case, the image receiving surface of the recording sheet is roughened or dented and/or spike marks are formed on the image receiving layer and thus the commercial value of the printed sheets is reduced.

In conventional printers equipped with a thermal head, a recording sheet comprising a substrate sheet, which comprises a core sheet and films having microvoid layers and laminated on the two surfaces of the core sheet, and an image receiving layer comprising, as a principal component, a dyeable resin and formed on a surface of the substrate sheet is commonly employed to obtain good printed images. For example, Japanese Patent Publication No. 2,565,866 discloses a substrate sheet for the recording sheet, comprising a core sheet and synthetic paper sheet layers, comprising as a principal component a propylene resin, laminated on the two surfaces of the core sheet. Also, Japanese Patent Publication No. 2,922,525 discloses a substrate sheet for the recording sheet, comprising a core paper sheet and oriented polyethylene terephthalate film layers, having a plurality of microvoids, laminated on the two surfaces of the core paper sheet.

The above-mentioned films having the microvoid layer are advantageous in that the films are uniform in thickness thereof and flexible and have a thermal conductivity lower than that of paper sheets made from cellulose fibers and, thus, thermally transferred images having a high uniformity and a high color density can be formed on the films. Generally, an increase in the number and size of the microvoids causes a decrease in density of the films and thus results in enhancement in the heat-insulation and thermal sensitivity of the film. However, the increase in the number and size of the microvoids of the films causes the mechanical strength of the films and the resistance of the films to roughening or denting by the sheet-transporting roller system to be reduced. When the resistance of the films to the roughening or denting by the sheet-transporting roller system is increased by increasing the density of the front surface side film, the thermal insulation of the film and the close contact of the films with the thermal head decreases, and thus the resultant recording sheet exhibits a degraded thermal sensitivity and the printed images exhibit an unsatisfactory quality.

Thus, to respond to the development of high speed printing, it is required to provide a new type of thermal transfer recording sheet having a good contact with the thermal heads of printers, a high thermal insulation and a high resistance to roughening and denting due to the high pressure of the sheet-transporting roller system of the printers.

Also, in the conventional thermal transfer recording sheet having a substrate sheet comprising a core sheet and films each having a microvoid layer and laminated on the two surfaces of the core sheet and an image receiving layer comprising, as a principal component, a dyeable resin and formed on a front surface of the substrate sheet, a phenomenon such that, when the recording sheet is printed by heating imagewise by a thermal head of the printer, the front film layer of the substrate sheet located below the image receiving layer is thermally shrunk to cause the recording sheet to be curled, apparently occurs. This phenomenon will be referred to as print curling phenomenon hereinafter. The print curling phenomenon causes the commercial value of the printed recording sheet to be significantly decreased.

It is known that, in the conventional thermal transfer recording sheet having a substrate sheet, which comprises a core sheet and films having a microvoid layer and laminated on the two surfaces of the core sheet, and an image receiving layer comprising, as a principal component, a dyeable resin and formed on a front surface of the substrate sheet, the print curling phenomenon can be rectified by differentiating in thickness and in thermal shrinkage between the front and back film layers of the substrate sheet. Namely, when the image receiving layer is formed on the front film layer surface of the substrate sheet by conventional coating and drying procedures, shrinkages of the front and back film layers occur due to the drying heat applied to the image receiving layer on the substrate sheet. The shrinking stresses generated in the front and back film layers are controlled by the above-mentioned means to rectify the print curling phenomenon on the recording sheet.

In this case, however, when the image receiving layer is coated on the substrate sheet and dried, two corner portions located on a diagonal line of the sheet having four corners are curled in the same direction (the image receiving layer side) as each other and extend upward with respect to the image receiving layer surface. This curling phenomenon is referred to a distortional curling phenomenon hereinafter. The distortional curling phenomenon causes the printed recording sheet to exhibit a significantly decreased commercial value.

The mechanism in which the distortional curling phenomenon occurs is assumed to be as follows.

Namely, the front and back films having a plurality of microvoids and laminated on the core sheet are produced through biaxial orienting (drawing) procedure. During the orienting procedure, a bowing phenomenon occurs. Due to the bowing phenomenon, in a center portion of the oriented film, the shrinkage is maximized in the longitudinal direction (MD) or transverse direction (TD) of the film, and in edge portions of the oriented film, the shrinkage of the film is maximized in directions different from the longitudinal and transverse directions of the film. Accordingly, when the edge portions of the film are used to form the film layers of the substrate sheet of the recording sheet, the resultant film layers thermally shrink in directions different from the longitudinal and transverse directions of the films in the procedure for forming the image receiving layer, and thus the distortional curling phenomenon occurs on the film layers during the procedure for forming the image receiving layer.

SUMMARY OF THE INVENTION

An object of the present invention is to provide a thermal transfer recording sheet capable of recording thereon thermally transferred ink images having high clarity and sharpness with a high sensitivity by various types of thermal transfer printers, and having a high resistance to roughening and denting due to nipping pressure of sheet-transporting roller system of the printer.

In an embodiment of the thermal transfer recording sheet of the present invention, a resistance of the recording sheet to print curling phenomenon.

The above-mentioned object can be attained by the thermal-transfer recording sheet of the present invention which comprises a substrate sheet and an image receiving layer formed on the front surface of the substrate sheet and comprising, as a principal component, a dyeable polymeric material, wherein the substrate sheet comprise a core sheet-layer and polyester film layers laminated on the front and back surfaces of the core sheet layer, and the recording sheet exhibits a compression modulus of 50 MPa or less determined in accordance with Japanese Industrial Standard K 7220.

The term "a compression modulus" refers to—a compressive modulus of elasticity—.

In the thermal transfer recording sheet of the present invention, the core sheet layer preferably comprises a polyolefin film.

In the thermal transfer recording sheet of the present invention, the polyolefin film for the core sheet layer is preferably selected from oriented porous polyolefin films.

In the thermal transfer recording sheet of the present invention, the polyester film for each of the front and back polyester film layers is preferably selected from oriented porous polyester films.

In the thermal transfer recording sheet of the present invention, in the substrate sheet, preferably, the core sheet layer has a compression modulus (A) of 45 MPa or less and the front and back polyester film layers respectively and independently from each other have compression moduluses (Ba) and (Bb) in the range of from 10 to 80 MPa, and the core sheet compression modulus (A) is lower than the front and back polyester film compression modulus (Ba) and (Bb).

The thermal transfer recording sheet of the present invention optionally further comprises a curling-rectification layer formed by melt-extrusion laminating a synthetic thermoplastic resin on the surface of the back polyester film of the substrate sheet.

In the thermal transfer recording sheet of the present invention, the synthetic thermoplastic resin for the curling-rectification layer preferably comprises, as a principal component, a polyolefin resin having a density of 0.91 to 0.96 g/cm$^3$, and the curling-rectification layer preferably has a thickness of 15 to 35 $\mu$m.

DESCRIPTION OF THE PREFERRED EMBODIMENTS

The inventors of the present invention have made an extensive study of the thermal transfer recording sheet, especially the substrate sheet for the recording sheet, and have found that the thermal transfer recording sheet having a high resistance to roughening and denting due to nipping pressure applied to the recording sheet by a recording sheet-transporting roller system of printer during printing procedure, a high sensitivity and high quality, clarity and sharpness of the images, can be obtained by using a substrate sheet comprising a core sheet and polyester film layers laminated on the two surfaces of the core sheet, and controlling the compression modulus of the recording sheet to 50 MPa or less, preferably 10 to 50 MPa, more preferably 10 to 45 MPa, still more preferably 10 to 40 MPa, determined in accordance with Japanese Industrial Standard (JIS) K 7220.

Namely, the thermal transfer recording sheet of the present invention comprises a substrate sheet and an image receiving layer formed on the front surface of the substrate sheet and comprising, as a principal component, a dyeable polymeric material. The substrate sheet comprises a core sheet layer and polyester film layers laminated on the front and back surfaces of the core sheet layer, and the recording sheet exhibits a compression modulus of 50 MPa or less determined in accordance with JIS K 7220.

If the compression modulus of the recording sheet is more than 50 MPa, the recorded images on the recording sheet are unsatisfactory in quality (clarity and sharpness) of the images, the image receiving surface of the recording sheet is roughened and dented by the nipping pressure applied to the image receiving surface by the recording sheet-transporting roller system of the printer, and thus the resultant printed sheet has a reduced commercial value. Also, even when the compression modulus of the recording sheet is 50 MPa or less, if oriented porous films comprising, as a principal component, for example, a polypropylene resin, are laminated, in place of the polyester films, on the two surfaces of the core sheet, the image-receiving surface of the resultant recording sheet exhibits an insufficient resistance to roughening and denting due to the nipping pressure applied to the recording sheet by the recording sheet-transporting roller system of the printer, and thus the resultant printed sheet exhibits an unsatisfactory quality.

The reasons of the high resistance of the recording sheet of the present invention to the roughening and denting due to the nipping pressure applied to the recording sheet by the recording sheet-transporting roller system of the printer and due to printing pressure applied to the recording sheet by the thermal head of the printer, are considered to be as follows. As, in the recording sheet of the present invention, the front and back surfaces of the core sheet are covered by polyester film layers having a high resistance to the roughening and denting due to the nipping pressure and printing pressure, and the core sheet is formed from sheet materials enabling the resultant recording sheet to exhibit a sufficiently low compression modulus, when the image receiving surface is locally pressed under a high pressure by the sheet-transporting roller system and the thermal head, the pressure can be absorbed in the inside of the recording sheet including the polyester film layers. Also, as the polyester film layers has a high heat resistance, a high smoothness and a low thermal conductivity, and the compression modulus of the recording sheet is sufficiently low, when the recording sheet is interposed between the thermal head and platen roller, the recording sheet can be appropriately deformed to enhance the close contact of the recording sheet with the thermal head, and to exhibit an excellent recording sensitivity and thus high quality images can be recorded on the recording sheet.

In the substrate sheet for the recording sheet of the present invention, the compression modulus of the core sheet is preferably controlled to 45 MPa or less, more preferably 20 MPa or less, still more preferably 3 to 10 MPa. Also, the compression modulus of the core sheet is preferably lower than that of the front and back polyester film layers. Further, the thickness of the core sheet is preferably controlled to 50 to 200 $\mu$m, more preferably 70 to 150 $\mu$m.

The core sheet preferably comprises a plastic film comprising, as a principal component, a member selected from polyolefin, for example, polypropylene, nylon, polyurethane, and polybutadiene resins; a drawn porous plastic film produced by mixing a thermoplastic resin with pigment particles and/or particles of a resin different from the thermoplastic resin, forming the mixed resin into an undrawn film, drawing the undrawn film to form a porous film; or a foamed film produced by mixing a thermoplastic resin with a foaming agent, forming the mixed resin into a film and foaming the film.

The core sheet may comprises a low density paper sheet comprising a pulp as a principal component and thermally expanded particles mixed with the pulp. The low density paper sheet preferably has a density of about 0.2 to 0.7 g/cm$^3$.

Among the above-mentioned films and sheets, polyolefin films, for example, polyethylene films and polypropylene films are preferably used for the core sheet. Particularly, multi-layered polyolefine films, prepared by forming a resin composition comprising, as principal components, a polyolefin resin with pigment particles into an undrawn film; biaxially drawing the undrawn film and having a plurality of microvoids (fine pores), are preferably employed for the core sheet. The above-mentioned films and sheets may be employed alone or in a composite of two or more members of the films and sheets which are superposed on and adhered to each other by a conventional laminating method, for example, a dry-laminate method, a wet laminate method or melt-laminate method. There is no limitation to the combinations of the films and sheets.

In the substrate sheet, the polyester films to be laminated on the front and back surfaces of the core sheet are preferably formed from at least one member selected from homopolyesters made from, for example, terephthalic acid and ethylene glycol and copolyesters of, for example, terephthalate, ethylene glycol and at least one additional comonomer. The additional comonomer is selected from hydroxycarboxylic acids, for example, p-hydroxybenzoic acid, aromatic dicarboxylic acids, for example, isophthalic acid and naphthalene dicarboxylic acids and alkylene glycols, for example, propylene glycol and tetramethylene glycol.

The polyester films for the substrate sheet are preferably selected from oriented polyester films. The oriented polyester films preferably have a microvoid, layer, containing a plurality of microvoids, which layer contributes to enhancing the cushioning property and the thermal insulation of the polyester films.

To control the compression modulus of the recording sheet to 50 MPa or less, the oriented polyester films-preferably have a compression modulus of 10 to 80 MPa, more preferably 10 to 50 MPa, still more preferably 10 to 30 MPa.

If the compression moduluses of the front and back-polyester films are less than 10 MPa, the resultant recording sheet may exhibit an insufficient resistance to roughening and denting of the image receiving surface. Also, if the compression modulus is more than 80 MPa, the ink receiving surface of the resultant recording sheet may exhibit an insufficient contact with the thermal head and the resultant images may be unsatisfactory in quality. The polyester film layers preferably have a thickness of 10 to 80 $\mu$m, more preferably 20 to 60 $\mu$m.

To form the microvoids in the polyester films, particles of a resin incompatible with the polyester resin and/or an inorganic filler (pigment) are uniformly dispersed in the polyestic resin, the resultant polyester resin composition is formed into a film, and the resultant film is drawn to form a plurality of microvoids. The incompatible resin to the polyester resin may be selected from polyolefin resins, for example, polyethylene and polypropylene resins, polystyrene, polybutadiene and polyacrylonitrile resins and copolymer resins of two or more of the above-mentioned polymers. The incompatible resin is not limited to the above-mentioned resins. The filler for the microvoid-having polyester films is preferably selected from, for example, particulate calcium carbonate, magnesium oxide, titanium dioxide, magnesium carbonate, aluminum hydroxide, sodium aluminosilicate, potassium aluminosilicate, clay, mica, talc, barium sulfate and calcium sulfate, which may be employed alone or in a mixture of two or more thereof. The oriented polyester films for the front and back film layers preferably have a thickness in the range of from 10 to 75 $\mu$m, more preferably from 20 to 55 $\mu$m.

In the substrate sheet of the thermal transfer recording sheet of the present invention, the compression modulus (A) of in the units of MPa the core sheet layer, and the compression moduluses in the units of MPa (Ba) and (Bb) of the front and back polyester film layers preferably satisfy the following requirements (1), (2) and (3).

$$A \leqq 45 \quad (1)$$

$$B = 10 \text{ to } 80 \quad (2)$$

$$A < B \quad (3)$$

When the substrate sheet satisfies the above-mentioned requirements, almost all of the pressure applied from the sheet-transporting roll system and the thermal head of the printer to the recording sheet during the printing procedure can be absorbed by the polyester film layers of the substrate sheet and thus the recording sheet can exhibit a high resistance to roughening and denting of the recording sheet.

In the preparation of the substrate sheet, the polyester films are adhered to the front and back surfaces of the core sheet by a conventional adhering method such as, for example, dry laminating method in which an adhesive, for example, a polyurethane adhesive or acrylic adhesive is employed, wet laminating method, melt-extrusion laminating method or calendering method.

The substrate sheet preferably has a thickness of 100 to 300 $\mu$m, more preferably 150 to 250 $\mu$m. If the thickness is less than 100 $\mu$m, the resultant substrate sheet may exhibit an insufficient mechanical strength, and the resultant recording sheet may exhibit unsatisfactory rigidity and stiffness, and an unsatisfactory resistance to the print curling phenomenon during the printing procedure. Also, if the thickness of the substrate sheet is more than 300 $\mu$m, the resultant recording sheet may have too large a thickness, thus the maximum number of the recording sheets containable in the sheet container of the printer may be too small, or the volume of the printer capable of containing the desired number of the recording sheets may be too large, and thus, it may be difficult to make the structure of the printer compact.

In the recording sheet of the present invention, an image receiving layer is formed on a surface of the substrate sheet by coating a coating composition comprising, as a principal component, a polymeric material having a high dyeability for disperse dyes, an additive comprising, for example, a cross-linking agent, an agent for preventing fuse-adhesion of the image receiving layer, and an ultraviolet ray-absorber, and drying the coated coating composition layer. The dyeable polymeric material is not limited to a-specific type of resin as long as the resin can be dyed with the disperse dye, and is usually selected from cellulose derivatives, for example, cellulose acetatebutylate and cellulose triacetate, polyvinylacetal resins, polyester-resins, for example, polyethylene terephthalate resins, polycarbonate resins, for example, polydiarylcarbonate resins, polyacrylic resins for example, poly(methylacrylate) resins and polyvinyl chloride resins. The ink receiving layer optionally further contains an additive comprising at-least one member selected from silicone oils, coloring pigments, coloring dyes, fluorescent dyes, plasticizers, antioxidants, and white pigments, unless the additive affects the effects of the present invention.

The cross-linking agent preferably comprises at least one member selected from, for example, isocyanate compounds and epoxy compounds. The ultraviolet ray absorber preferably comprises at least one member selected from ultraviolet ray-absorbing benzotriazole compounds, benzophenone compounds, phenylsalicylate compounds, and cyanoacrylate compounds. The fuse-adhesion-preventing agent comprises lubricants and/or a releasers, for example, silicone resins, for example, amino-modified and hydroxyl-modified silicone oils and acryl silicone resins, prepolymers of silicone oils with isocyanate compounds, silicone compounds, fluorine compounds, phosphate ester compounds, and fatty acid ester compounds. The above-mentioned components for the image receiving layer preferably cross-linkable by the cross-linking agents.

The ink receiving layer is preferably-formed in an amount controlled in the range of from 1 to 12 g/m$^2$, more preferably from 3 to 10 g/m$^2$. If the amount of the image receiving layer is less than 1 g/m$^2$, the resultant image receiving layer may be difficult to completely cover the front surface of the substrate sheet, and thus the recorded images may have an unsatisfactory quality and, sometimes, the image receiving layer is fuse-adhered to the ink sheet when the image receiving layer is heated imagewise through the ink sheet by a thermal head of the printer. Also, if the amount of the image receiving layer is more than 12 g/m$^2$, the effect of the image receiving layer may be saturated, thus, the cost of the recording sheet may meaninglessly increase, and the resultant recording sheet may be disadvantageous in that the image receiving layer exhibits an insufficient mechanical strength and has too large a thickness, thus the heat-insulation effect of the substrate sheet cannot sufficiently appear, and the recorded images on the image receiving layer exhibit an unsatisfactory color density.

The recording sheet of the present invention optionally has a backcoat layer formed on the back polyester film layer of the substrate sheet. The backcoat layer preferably comprises a synthetic resin usable as an adhesive resin or binder resin. The resin contributes to enhancing the bonding strength of the backcoat layer to the substrate sheet. The resin-containing backcoat layer contributes to enhancing the easy transporting property of the recording sheet, and to protecting the image receiving layer of the recording sheet from damage, for example, scratch marks. The resin for the backcoat layer comprises at least one member selected from acrylic resins, epoxy resins, polyester resins, phenolic resins, alkyl resins, urethane resins, melamine resins, polyvinyl acetal resins and reaction-cured products of the above-mentioned resins.

In the recording sheet of the present invention, the backcoat layer formed on the back polyester film layer of the substrate sheet optionally comprises an antistatic agent. The antistatic agent preferably comprises an electrical conductive polymeric material which may be cationic, anionic or non-ionic, and an electrically conductive organic pigment. The electrically conductive polymeric material is preferably selected from cationic polymeric materials. The cationic polymeric material is preferably selected from polyethyleneimine, cationic monomer-containing acrylic polymers, cation-modified acrylamide polymers and cationic starches. The electrically conductive inorganic pigment is preferably selected from compound semiconductor pigments, for example, inorganic oxides and sulfides, and coated inorganic pigments prepared by coating particles of the inorganic pigments with the compound semiconductors.

The compound semiconductors include copper (I) oxide, zinc oxide, zinc sulfide and silicon carbide, and the compound semiconductor-coated inorganic pigments include titanium dioxide and potassium titanate particles coated with semiconductor tin oxide.

The backcoat layer of the recording sheet of the present invention optionally further contains an organic and/or inorganic filler as a friction coefficient-adjusting agent. The organic filler preferably comprises, for example, a nylon powder, a cellulose powder and/or a urea resin powder. The inorganic filler preferably comprises, for example, a silica powder and/or a barium-sulfate powder.

The backcoat layer is preferably formed in an amount of 0.3 to 10 g/m$^2$, more preferably 1 to 5 g/m$^2$. If it is less than 0.3 g/m$^2$, the resultant backcoat layer may not able to prevent formation of scratch marks on the image receiving layer surfaces when the recording sheet are superposed on each other, and are rubbed with each other, and may have coating defects which causes the electrical surface resistivity of the recording sheet to increase. Also, when the amount of the backcoat layer is more than 10 g/m$^2$, the effect of the backcoat layer is saturated and an economical disadvantage occurs.

The image receiving layer and the backcoat layer can be formed by coating a coating liquid by using a conventional coater, for example, bar coater, gravure coater, comma coater, blade coater, air knife coater, curtain coater or die coater and then by drying the coated coating liquid layer.

In an embodiment of the recording sheet of the present invention, a curling-rectification layer is formed, as a backcoat layer, on the back polyester film layer of the substrate sheet. The curling-rectification layer is formed by melt-extrusion laminating a synthetic thermoplastic resin on the surface of the back polyester film layer of the substrate sheet.

The synthetic thermoplastic resin for the curling-rectification layer preferably comprises, as a principal component, a polyolefin resin-having a density of 0.91 to 0.96 g/cm$^3$, more preferably 0.93 to 0.96 g/cm$^3$.

If the density of the polyolefin is less than 0.91 g/cm$^3$, the resultant polyolefin resin layer may exhibit too low a shrinkage while the layer is formed by the melt-extrusion laminating procedure and is in the state of a melt; the solidified polyolefin layer may exhibit too low a modulus of elasticity, and thus the curl-rectification effect of the polyolefin resin layer formed as a curl-rectification layer may be insufficient.

Also, if the density of the polyolefin resin is more than 0.96 g/cm$^3$, the resultant polyolefin resin layer may exhibit an insufficient bonding strength to the back polyester film layer of the substrate sheet, and the thickness of the polyolefin resin layer may be difficult to keep uniform during the melt-extrusion laminating procedure. Thus, in the resultant recording sheet having the backcoat polyolefin resin layer, it may be difficult to control the curl-rectification effect in the printing procedure.

In the formation of the curl-rectification layer, the melt-extrusion laminating is preferably carried out at a temperature of 270 to 330° C. If the laminating temperature is lower than 270° C., the shrinkage of the melt-extrusion-laminated resin layer may be low, and thus the resultant backcoat layer may exhibit an unsatisfactory curl-rectification effect and an insufficient bonding strength to the back polyester film layer. Also, if the melt extrusion-laminating temperature is higher than 330° C., the synthetic resin comprising, as a principal component, the polyolefin resin may be thermally decomposed, the resin melt may exhibit a reduced viscosity and thus the thickness of the resultant curl rectification layer may be difficult to keen uniform.

The curl-rectification layer is preferably formed in an amount of 5 to 50 g/m$^2$, more preferably 15 to 35 g/m$^2$. Also, the curl-rectification layer preferably has a thickness of 5 to 50 $\mu$m, more preferably 15 to 35 $\mu$m. If the coating amount of the curl-rectification layer is less than 5 g/m$^2$, the resultant layer may exhibit an insufficient curl-rectification effect. Also, if the coating amount of the curl-rectification layer is more than 50 g/m$^2$, the curl-rectification effect of the resultant layer may be saturated to cause an economical disadvantage and the thickness of the resultant layer may be too large.

The curl-rectification layer optionally further comprises an organic and/or inorganic filler as a friction coefficient-adjusting agent. The organic filler preferably comprises, for example, a nylon powder, a cellulose powder and/or a urea resin powder. The inorganic filler preferably comprises, for example, a silica powder and/or a barium sulfate powder.

Also, the curl-rectification layer optionally further contains other additives such as, for example, an antistatic agent and/or an anti-blocking agent. The anti-blocking agent may comprise, for example, a fatty acid amide.

The recording sheet of the present invention optionally further comprises an outermost backcoat layer formed on the curl-rectification layer.

The outermost backcoat layer preferably comprises a synthetic resin usable as an adhesive resin or binder resin. The resin contributes to enhancing the bonding strength of the outermost backcoat layer to the curl-rectification layer. The resin-containing outermost backcoat layer contributes to enhancing the easy transporting property of the recording sheet, and to protecting the image receiving layer of the recording sheet from damage such as, for example, scratch marks. The resin for the outermost backcoat layer comprises at least one member selected from acrylic resins, epoxy resins, polyester resins, phenolic resins, alkyl resins, urethane resins, melamine resins, polyvinyl acetal resins and reaction-cured products of the above-mentioned resins.

The outermost backcoat layer is preferably formed in an amount of 0.3 to 10 g/m$^2$, more preferably 1 to 5 g/m$^2$. If it is less than 0.3 g/m$^2$, the resultant outermost backcoat layer may not able to fully prevent formation of the scratch marks on the image receiving layer surfaces when the recording sheet are superposed on each other, and are rubbed with each other. Also, the outermost backcoat layer may have coating defects which causes the electrical surface resistivity of the recording sheet to increase. Also, when the amount of the outermost backcoat layer is more than 10 g/m$^2$, the effect of the outermost backcoat layer is saturated to cause an economical disadvantage.

The outermost backcoat layer formed on the curl-rectification layer optionally comprises an antistatic agent. The antistatic agent preferably comprises an electrical conductive polymeric material which may be cationic, anionic or non-ionic, and an electrical-conductive organic pigment. The electrical conductive polymeric material is preferably selected from cationic polymeric materials. The cationic polymeric material is preferably selected from polyethyleneimine, cationic monomer-containing acrylic polymers, cation-modified acrylamide polymers and cationic starches. The electrical conductive inorganic pigment is preferably selected from compound semiconductor pigments, for example, inorganic oxides and sulfides, and coated inorganic pigments prepared by coating particles of the inorganic pigments with the compound semiconductors.

The compound semiconductors include copper (I) oxide, zinc oxide, zinc sulfide and silicon carbide, and the compound semiconductor-coated inorganic pigments include titanium dioxide and potassium titanate particles coated with semiconductor tin oxide.

The outermost backcoat layer of the recording sheet of the present invention optionally further contains an organic and/or inorganic filler as a friction coefficient-adjusting agent. The organic filler preferably comprises, for example, a nylon powder, a cellulose powder and/or a urea resin powder. The inorganic filler preferably comprises, for example, a silica powder and/or a barium sulfate powder.

The outermost backcoat layer can be formed by coating a coating liquid by using a conventional coater, for example, bar coater, gravure coater, comma coater, blade coater, air knife coater, curtain coater or die coater and then by drying the coated coating liquid layer.

The substrate sheet of the thermal transfer recording sheet of the present invention optionally further comprises a pressure-sensitive adhesive layer arranged between the core sheet layer and the back polyester film layer. Optionally, a release agent layer is arranged between the pressure-sensitive adhesive layer and the back polyester film layer.

Alternatively, the surface of the back polyester film layer is coated with a pressure-sensitive adhesive agent and then a release sheet is detachably adhered to the pressure-sensitive adhesive agent layer. In these cases, the resultant thermal transfer recording sheet of the present invention can be utilized as a sticker label or a seal label.

EXAMPLES

The present invention will be further illustrated by the following examples which are not intended to restrict the scope of the present invention in any way.

Example 1

A substrate sheet comprising a core sheet made from a synthetic paper sheet (trademark: YUPO FPG 95, made by YUPO CORPORATION.) having a thickness of 95 μm and compression modulus of 7 MPa and front and back biaxially oriented porous polyester films (trademark: POLYESTER FILM 50E63S, made by TORAY) having a thickness of 50 μm and a compression modulus of 50 MPa containing inorganic pigment particles, was produced by laminate-bonding the front and back polyester films to the front and back surfaces of the core sheet through an adhesive comprising an urethane resin by a dry lamination system.

Then, a coating liquid for an image receiving layer and having the composition as shown below is coated in a dry solid amount of 8 g/m$^2$ on the front polyester film layer surface and dried at a temperature of 120° C. for one minute, to form an image receiving layer.

Composition of coating liquid for image receiving layer

| Component | Amount in parts by mass |
|---|---|
| Polyester resin $(*)_1$ | 100 |
| Silicone resin $(*)_2$ | 3 |
| Isocyanate $(*)_3$ | 5 |
| Toluene | 300 |

[Note]
$(*)_1$ - Trademark: Vylon 200, made by TOYOBO K.K.
$(*)_2$ - Trademark: KF101, made by SHINETSU KAGAKUKOGYO K.K.
$(*)_3$ - Trademark: TAKENAT D-140N, made by TAKEDA YAKUHIN K.K.

The resultant precursory recording sheet was wound around a winding roll and heated at a temperature of 60° C. for 48 hours in an oven, to promote the cross-linking reaction of the polyester resin with the isocynate.

The precursory recording sheet was unwound from the winding roll and the back surface of the precursory recording sheet was coated with a coating liquid for a backcoat layer and having the composition as shown below, in a dry solid amount of 3 g/m$^2$, and dried at a temperature of 120° C. for one minute to form a backcoat layer. A thermal transfer recording sheet was obtained.

Composition of coating liquid for backcoat layer

| Component | Amount in part by mass |
|---|---|
| Polyvinyl acetal resin $(*)_4$ | 25 |
| Polyacrylate ester resin $(*)_5$ | 12 |
| Particulate Nylon resin having an average particle size of 5 μm $(*)_6$ | 3 |
| Silicone resin (KF101) $(*)_2$ | 15 |
| Zinc stearate dispersion $(*)_7$ | 3.3 |
| Cationic electrical conductive polymer $(*)_8$ | 5.9 |
| Isopropyl alcohol | 55.7 |
| Water | 42.1 |

[Note]
$(*)_4$ - Trademark: ESLEC KX-1, made by SEKISUI KAGAKUKOGYO K.K.
$(*)_5$ - Trademark: JURYMER AT 613, made by NIHON JUNYAKU K.K.
$(*)_6$ - Trademark: ORGASOL, made by Alpha-PHOTOCHEM K.K.
$(*)_7$ - Trademark: Z-7-30, made by CHYUKYO YUSHI K.K.
$(*)_8$ - Trademark: CHEMISTAT 9800, made by SANYO KASEIKOGYO K.K.

Example 2

A thermal transfer recording sheet was produced by the same procedures as in Example 1, except that for the core sheet, the synthetic paper sheet (YUPO FPG 95) was replaced by an polyethylene film having a thickness of 100 μm and a compression modulus of 40 MPa (trademark: TP SHEET H(C), made by SUMITOMO KAGAKUKOGYO K.K.).

Example 3

A thermal transfer recording sheet was produced by the same procedures as in Example 1, except that for the core sheet, the synthetic paper sheet (YUPO FPG 95) was replaced by a polypropylene film having a thickness of 110 μm and a compression modulus of 38 MPa (trademark: PURESOFTY HR111, made by IDEMITSU K.K.).

Example 4

A thermal transfer recording sheet was produced by the same procedures as in Example 1, except that for the core sheet, the synthetic paper sheet (YUPO FPG 95) was replaced by a low density paper sheet having a thickness of 100 μm, a density of 0.6 g/m$^3$ and a compression modulus of 37 MPa and produced from a pulp slurry containing thermal expansible particles (trademark: MATSUMOTO MICROSPHERE F30, made by MATSUMOTO YUSHI K.K.) in an amount of 10% by mass based on the mass of the pulp.

Example 5

A thermal transfer recording sheet was produced by the same procedures as in Example 1, except that front and back oriented porous polyester films having a thickness of 38 μm and a compression modulus of 15 MPa were laminate-bonded in place of the front and back polyester films (50E63S) to the front and back surfaces of the core sheet.

Example 6

A thermal transfer recording sheet was produced by the same procedures as in Example 1, except that a synthetic paper sheet (trademark: YUPO FPG 150, made by YUPO CORP.) having a thickness of 150 μm was employed as a core sheet in place of the synthetic paper sheet (YUPO FPG 95), and transparent polyester films (trademark: EMBLED, made by YUNICHIKA K.K.) having a thickness of 12 μm and a compression modulus of 78 MPa were employed as-front and back polyester films in place of the porous polyester films (50E63S).

Comparative Example 1

A thermal transfer recording sheet was produced by the same procedures as in Example 1, except that a coated paper sheet (trademark: OK TOPCOAT N, made by OJI PAPER CO.) having a thickness of 130 μm and a compression modulus of 86 MPa was employed as a core sheet in place of the synthetic paper sheet (YUPO FPG 95).

Comparative Example 2

A thermal transfer recording sheet was produced by the same procedures as in Example 1, except that a polyester film (trademark: EMBLED, made by YUNICHIKA K.K.) having a thickness of 100 μm and a compression modulus of 90 MPa was used as a core sheet in place of the synthetic paper sheet (YUPO FPG 95).

Comparative Example 3

A thermal transfer recording sheet was produced by the same procedures as in Example 1, except that a coated paper sheet (trademark: OK TOPCOAT N, made by OJI PAPER CO.) having a thickness of 130 μm, a basis weight of 157 g/m$^2$ and a compression modulus of 86 MPa was employed as a core sheet in place of the synthetic paper sheet (YUPO FPG 95), and transparent polyester films (trademark: EMBLED, made by YUNICHIKA K.K.) having a thickness of 12 μm and a compression modulus of 78 MPa were employed as front and back polyester films in place of the porous polyester films (50E63S).

Comparative Example 4

A thermal transfer recording sheet was produced by the same procedures as in Example 1, except that synthetic paper sheets (trademark: YUPO FPG 60, made by YUPO CORP.) having a thickness of 60 μm and a compression modulus of 7 MPa were employed in place of the front and back porous polyester films (50E63S).

Tests

Samples of the thermal transfer recording sheets of Examples 1 to 6 and Comparative Examples 1 to 4 were subjected to the following tests.

(1) Compression Modulus

The compression modulus of each example was measured in accordance with Japanese Industrial Standard (JIS) K 7220-1995, Testing Method for Compressive Properties of Rigid Cellular Plastics. The testing procedure was carried out at a real thickness of the sample of about 200 μm at a compression speed of 20 μm/min.

(2) Dent Resistance

Each sample was subjected to a printing procedure using a thermal transfer video printer (Model: M1, made by SONY) under a nipping pressure of 19.6 MPa (200 kg/cm$^2$), determined by using a pressure-testing film (trademark: PRESS SCALE, made by FUJI FILM K.K.), of a recording sheet-transporting roller system. After printing, the surface appearance of the tested sample was observed with the naked eye and evaluated into the following three classes.

| Class | Surface appearance |
|---|---|
| 3 | No dent appears |
| 2 | Slight dents appear |
| 1 | Significant dents appear |

(3) Image Properties

Each sample of the recording sheets were subjected to a thermal transfer printing procedure using a thermal transfer video printer (Model: UP50, made by SONY) in which the sample of the recording sheet was brought into contact with each of yellow, magenta and cyan-coloring ink sheets each comprising a polyester film substrate having a thickness of 6 μm and an ink layer formed on the substrate and comprising a mixture of a yellow, magenta or cyan-coloring ink with a binder, and the ink sheet was heated in various levels of energy application by a thermal head to thermally transfer the coloring ink imagewise to the sample of the recording sheet, and to record desired single colored images and mixed colored images in various gradations on the recording sheet sample.

The recorded colored images were subjected to measurement of reflected color density of the image in each level of energy application by using Macbeth reflection color density tester (Model: RD-914, made by KOLLMORGEN CO.). The color density of images recorded at a lowest fourth level of the energy application was reported as a color density of the images at a low gradation.

Also, the uniformity in color density and appearance of the images at a gradation corresponding to a color density of 1.0 of black-colored images were evaluated into the following three classes.

| Class | Uniformity of colored images |
|---|---|
| 3 | Color density is even. No color-missing is found. |
| 2 | Color density is slightly uneven and/or slight color-missing is found. |
| 1 | Color density is uneven and/or significant color-missing is found. |

The test results are shown in Table 1.

TABLE 1

| Example No. | | Item: Compression modulus (MPa) | Dent resistance | Uniformity of images | Color density of images in low gradation |
|---|---|---|---|---|---|
| Example | 1 | 38 | 3 | 3 | 0.32 |
| | 2 | 44 | 2 | 3 | 0.32 |
| | 3 | 43 | 2 | 3 | 0.32 |
| | 4 | 43 | 3 | 2 | 0.32 |
| | 5 | 12 | 3 | 3 | 0.39 |
| | 6 | 48 | 3 | 2 | 0.28 |
| Comparative Example | 1 | 73 | 1 | 2 | 0.30 |
| | 2 | 89 | 1 | 3 | 0.30 |
| | 3 | 82 | 1 | 1 | 0.15 |
| | 4 | 7 | 1 | 3 | 0.28 |

Example 7

A substrate sheet comprising a core sheet made from a synthetic paper sheet (trademark: YUPO FPG 95, made by YUPO CORPORATION.) having a thickness of 95 μm and compression modulus of 7 MPa and front and back biaxially oriented multi-layered polyester films (trademark: POLYESTER FILM 50E63S, made by TORAY) having a-thickness of 50 μm and a compression modulus of 50 MPa containing inorganic pigment particles, was produced by laminat-bonding the front and back polyester films to the front and back surfaces of the core sheet, through an adhesive comprising an urethane resin, by a dry lamination system.

A polyethylene resin (trademark: PETROSEN 204, made by TOSO K.K.) was melt extrusion-laminated on the back polyester film layer surface of the substrate sheet to form a curl-rectification layer having a thickness of 35 μm.

Then, a coating liquid for an image receiving layer and having the composition as shown below is coated in a dry solid amount of 8 g/m$^2$ on the front polyester film layer surface and dried at a temperature of 120° C. for one minute, to form an image receiving layer.

Composition of coating liquid for image receiving layer

| Component | Amount in parts by mass |
|---|---|
| Polyester resin $(*)_1$ | 100 |
| Silicone resin $(*)_2$ | 3 |
| Isocyanate $(*)_3$ | 5 |
| Tolnene | 300 |

The resultant precursory-recording sheet was wound around a winding roll and heated at a temperature of 50° C. for 24 hours in an oven, to promote the cross-linking reaction of the polyester resin with the isocynate.

The precursory recording sheet was unwound from the winding roll and the curl-rectification layer surface of the precursory recording sheet was coated with a coating liquid for an outermost backcoat layer and having the composition as shown below, in a dry solid amount of 3 g/m$^2$, and dried at a temperature of 120° C. for one minute to form an outermost backcoat layer. A thermal transfer recording sheet was obtained.

Composition of coating liquid for outermost backcoat layer

| Component | Amount in part by mass |
|---|---|
| Polyvinyl acetal resin $(*)_4$ | 25 |
| Polyacrylate ester resin $(*)_5$ | 12 |
| Particulate Nylon resin having an average particle size of 5 μm $(*)_6$ | 3 |
| Silicone resin (KF101) $(*)_2$ | 15 |
| Zinc stearate dispersion $(*)_7$ | 3.3 |
| Cationic electrical conductive polymer $(*)_8$ | 5.9 |
| Water | 42.1 |
| Isopropyl alcohol | 55.7 |

Example 8

A thermal transfer recording sheet was produced by the same procedures as in Example 7, except that the curl-rectification layer was formed in a thickness of 25 μm from a ethylene-vinyl acetate copolymer resin (trademark: ULTRASEN 725, made by TOSO K.K.).

Example 9

A thermal transfer recording sheet was produced by the same procedures as in Example 1, except that the curl-rectification layer was formed in a thickness of 15 μm from a polyethylene resin (trademark: NIPOLON HARD 2400, made by TOSO K.K.).

Example 10

A thermal transfer recording sheet was produced by the same procedures as in Example 1, except that the curl-rectification layer was formed in a thickness of 35 μm from a polyethylene resin (trademark: NIPOLON HARD 2400, made by TOSO K.K.).

Example 11

A thermal transfer recording sheet was produced by the same procedures as in Example 1, except that the curl-rectification layer was formed in a thickness of 35 μm from a polypropylene resin (trademark: JEIREX HD, made by NIHON POLYOLEFIN K.K.).

Example 12

A thermal transfer recording sheet was produced by the same procedures as in Example 2, except that to provide the core sheet, a polyopropylene film (trademark: PURESOFTY HR 111, made by IDEMITSU K.K.) having a thickness of 110 μm and a compression modulus of 38 MPa was employed.

Example 13

A thermal transfer recording sheet was produced by the same procedures as in Example 2, except that to provide the core sheet, a synthetic paper sheet (trademark: YUPO FPG 150, made by YUPO CORP.) having a thickness of 150 μm and a compression modulus of 6 MPa was employed, and to provide the front and back polyester film layers, transparent polyester films (trademark: EMBLED, made by YUNICHIKA K.K.) having a thickness of 12 μm and a compression modulus of 78 MPa were employed.

Comparative Example 5

A thermal transfer recording sheet was produced by the same procedures as in Example 1, except that the core sheet was formed from a coated paper sheet (trademark: OK TOPCOAT, made by OJI PAPER CO.) having a basis weight of 104.7 g/m$^2$ and a compression modulus of 95 MPa, and the front and back surfaces of the core sheet were laminate-adhered with biaxially-oriented, multi-layered polypropylene films (trademark: YUPO FPU 60, made by YUPO CORP.) containing inorganic pigment particles and having a thickness of 60 μm and a compression modulus of 7 MPa, through an adhesive comprising a urethane resin, by a dry lamination procedure.

Comparative Example 6

A thermal transfer recording sheet was produced by the same procedures as in Comparative Example 5, except that the core sheet was formed from a polyester film (trademark: EMBLET, made by YUNICHIKA K.K.) having a thickness of 100 μm and a compression modulus of 90 MPa.

Tests

Samples of the thermal transfer recording sheets of Examples 7 to 13 and Comparative Examples 5 to 6 were subjected to the following tests.

(1) Compression Modulus

The compression modulus of each samples was measured by the same test method as mentioned above.

(2) Print-curling Property

A sample of the recording sheet of A5 size (148 mm×210 mm) was placed on a flat, horizontal plane while allowing the four corner portions of the sample to curl upward, and distances in mm between the top points of the curled corners and the flat, horizontal plane were measured by using a JIS class 1 scale.

The curling property of the recording sheet before printing was represented by a largest value of the measured four distances in mm. When the recording sheet sample was placed on the flat, horizontal plane in such a manner that the back surface (opposite to the image receiving layer surface) of the recording sheet sample comes into contact with the plane, the resultant curling distance was shown by a positive (+) value. When the recording sheet sample was placed on the plane so that the image receiving layer surface comes into contact with the plane, the resultant curling value is indicated by a negative (−) value.

The recording sheet sample was subjected to a thermal transfer solid printing procedure using a thermal transfer video printer (Model: UP50, made by SONY) in which the recording sheet sample was brought into contact with each of yellow, magenta and cyan-coloring ink sheets each comprising a polyester film substrate having a thickness of 6 μm and an ink layer formed on the substrate and comprising a mixture of a yellow, magenta or cyan-coloring ink with a binder.

In the solid printing procedure, the heating energy was adjusted so that the solid-printed black color exhibited a color density of 2. After the solid printing was completed, the printed recording sheet sample was left standing in the ambient atmosphere for 5 minutes and subjected to the same curling measurement as mentioned above, to determine the curling property of the recording sheet after printing.

(3) Dent Resistance

Each sample was subjected to a printing procedure using a thermal transfer video printer (Model: UP50, made by SONY) using yellow-, magenta- and cyan-coloring ink sheets each comprising a polyester film substrate having a thickness of 6 μm and an ink layer formed on the substrate and comprising a mixture of a coloring ink with a binder, to thermally transfer ink images in simple colors and superpored and mixed colors in a moderate gradation from each ink sheet to the recording sheet sample. The printed images were subjected to Macbeth reflection color density meter (model: RD-914, made by KOLLMORGEN CO.).

The portions of the printed surface of the recording sheet sample having colored images in a gradation corresponding to a color density of 2.0 of black colored images, were observed by the naked eye whether dents were formed on the portions. The test results were classified into the following two classes.

| Class | Dent |
|---|---|
| 2. | No dent appears. |
| 1. | Significant dents are formed. |
| | The test results are shown in Table 2. |

TABLE 2

| Example No. | Type of film layers | Curl-rectification layer: Type of principal resin component | Density (g/cm³) | Thickness (μm) | Uniformity in thickness | Dent resistance | Curling property (mm): Before printing | After printing | Compression modulus (MPa) |
|---|---|---|---|---|---|---|---|---|---|
| Example 7 | PESF | PE | 0.923 | 35 | Good | 2 | −8 | 0 | 35 |
| 8 | PESF | PE | 0.942 | 25 | Good | 2 | −7 | +1 | 33 |
| 9 | PESF | PE | 0.952 | 15 | Good | 2 | −6 | +2 | 28 |
| 10 | PESF | PE | 0.952 | 35 | Good | 2 | −10 | −2 | 36 |
| 11 | PESF | PP | 0.910 | 35 | Good | 2 | −7 | +1 | 34 |
| 12 | PESF | PE | 0.942 | 25 | Good | 2 | −7 | 0 | 42 |
| 13 | PESF | PE | 0.942 | 25 | Good | 2 | −7 | 0 | 47 |
| Comparative Example 5 | PPF | PE | 0.923 | 35 | Good | 1 | −8 | +1 | 30 |
| 6 | PPF | PE | 0.923 | 35 | Good | 1 | −10 | 0 | 30 |

Note
PESF: Polyester films
PPF: Polypropylene films
PE: Polyethylene resin
PP: Polypropylene resin Table 2 clearly shows that the recording sheets of Examples 7 to 13 exhibited high sensitivity to the thermal transfer printing, and high resistances to curling after printing to dents due to the nipping pressure applied by the sheet-transporting roller system and due to heat-pressing by the thermal head, and the printed images have high clarity and sharpness. Compared with them, the recording sheets of the comparative examples were unsatisfactory in at least one item of the dent resistance and curl resistance.

The thermal transfer recording sheet of the present invention exhibits a high resistance to denting due to the nipping pressure of the recording sheet-transporting roller system of the thermal printer and can record thereon ink images having excellent clarity and sharpness. Also, when a specific curl-rectification layer is provided on the back surface of the substrate sheet, the resultant recording sheet of the present invention exhibits a high resistance to curling due to the thermal printing.

What is claimed is:

1. A thermal transfer recording sheet comprising a substrate sheet and an image receiving layer formed on the front surface of the substrate sheet and comprising, as a principal component, a dyeable polymeric material, wherein the substrate sheet comprises a core sheet layer and polyester film layers laminated on the front and back surfaces of the core sheet layer, and the recording sheet exhibits a compression modulus of 50 MPa or less determined in accordance with JIS K 7220.

2. The thermal transfer recording sheet as claimed in claim 1, wherein the core sheet layer comprises a polyolefin film.

3. The thermal transfer recording sheet as claimed in claim 2, wherein the polyolefin film for the core sheet layer is selected from oriented porous polyolefin films.

4. The thermal transfer recording sheet as claimed in claim 1, wherein the polyester film for each of the front and back polyester film layers is selected from oriented porous polyester films.

5. The thermal transfer recording sheet as claimed in claim 1, wherein in the substrate sheet, the core sheet layer has a compression modulus (A) of 45 MPa or less and the front and back polyester film layers respectively and independently from each other have compression moduluses (Ba) and (Bb) in the range of from 10 to 80 MPa, and the core sheet compression modulus (A) is lower than the front and back polyester film compression moduluses (Ba) and (Bb).

6. The thermal transfer recording sheet as claimed in claim 1, further comprising a curling-rectification layer formed by melt-extrusion laminating a synthetic thermoplastic resin on the surface of the back polyester film layer of the substrate sheet.

7. The thermal transfer recording sheet as claimed in claim 6, wherein the synthetic thermoplastic-resin for the curling-rectification layer comprises, as a principal component, a polyolefin resin having a density of 0.91 to 0.96 g/cm$^3$, and the curling-rectification layer has a thickness of 15 to 35 $\mu$m.

* * * * *